US012180815B1

(12) United States Patent
Luo et al.

(10) Patent No.: US 12,180,815 B1
(45) Date of Patent: Dec. 31, 2024

(54) IDENTIFYING HYDROGEN SWEET SPOTS IN SUBSURFACE FORMATIONS

(71) Applicant: Saudi Arabian Oil Company, Dhahran (SA)

(72) Inventors: Pan Luo, Dhahran (SA); Ibrahim Alfraih, Dhahran (SA); Peng Lu, Dhahran (SA); Harald Karg, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/664,641

(22) Filed: May 15, 2024

(51) Int. Cl.
*E21B 49/08* (2006.01)
*E21B 43/243* (2006.01)

(52) U.S. Cl.
CPC ..... *E21B 43/243* (2013.01); *E21B 49/087* (2013.01)

(58) Field of Classification Search
CPC ... E21B 49/0875; E21B 49/087; E21B 49/088
See application file for complete search history.

(56) References Cited

U.S. PATENT DOCUMENTS

| | | | | |
|---|---|---|---|---|
| 11,047,233 | B2 * | 6/2021 | Luo | G01N 33/2823 |
| 11,099,292 | B1 * | 8/2021 | Vinegar | G01N 24/081 |
| 11,442,053 | B2 | 9/2022 | Aboussou et al. | |
| 12,019,038 | B2 * | 6/2024 | Sandu | G01N 24/081 |
| 2007/0100594 | A1 | 5/2007 | Lamoureux-Var et al. | |
| 2013/0262069 | A1 * | 10/2013 | Leonard | E21B 43/00 703/10 |
| 2015/0329785 | A1 * | 11/2015 | Vinegar | C09K 8/58 208/189 |
| 2021/0062649 | A1 * | 3/2021 | Luo | E21B 49/082 |
| 2022/0042413 | A1 * | 2/2022 | Wang | G01N 33/2823 |
| 2022/0228997 | A1 * | 7/2022 | Sandu | G01N 31/12 |
| 2023/0272698 | A1 | 8/2023 | Darrah et al. | |

(Continued)

FOREIGN PATENT DOCUMENTS

WO WO 2023200864 10/2023

OTHER PUBLICATIONS

Behar et al., "Thermal cracking of kerogen in open and closed systems: determination of kinetic parameters and stoichiometric coefficients for oil and gas generation," Organic Chemistry, Mar.-Apr. 1997, 26(5-6):321-339, 19 pages.

(Continued)

*Primary Examiner* — Shane Bomar
(74) *Attorney, Agent, or Firm* — Fish & Richardson P.C.

(57) ABSTRACT

Systems and methods for identifying natural hydrogen sweet spots in a subsurface formation include obtaining rock samples from the subsurface formation; performing pyrolysis of the rock samples to determine an amount of hydrogen generated in the rock samples; determining kinetic parameters based on the performed pyrolysis and a thermal history of the subsurface formation; simulating hydrogen generation in the subsurface formation based on the determined kinetic parameters and the thermal history to predict target maturity data for hydrogen richness in the subsurface formation; measuring total organic content and rock sample maturity data for the rock samples; and identifying hydrogen sweet spots in the subsurface formation based on the target maturity data, the total organic content, and the measured rock sample maturity data.

21 Claims, 9 Drawing Sheets

(56) References Cited

U.S. PATENT DOCUMENTS

| | | | | |
|---|---|---|---|---|
| 2023/0340876 | A1* | 10/2023 | Luo | G01N 33/2841 |
| 2023/0393114 | A1 | 12/2023 | Darrah et al. | |
| 2024/0053319 | A1* | 2/2024 | Anifowose | E21B 49/02 |

OTHER PUBLICATIONS

Boreham et al., "Hydrogen in Australian natural gas: occurrences, sources and resources," The APPEA Journal, Jul. 2, 2021, 61(1):163-191, 29 pages.
Campbell et al., "Gas evolution during oil shale pyrolysis. 1. Nonisothermal rate measurements," Fuel, Oct. 1980, 59(10):718-726, 9 pages.
Campbell, "Pyrolysis of subbituminous coal in relation to in-situ coal gasification," Fuel, Apr. 1978, 57(4):217-224, 8 pages.
Frery et al., "Natural hydrogen exploration in Australia—state of knowledge and presentation of a case study," The APPEA Journal, May 13, 2022, 62(1):223-234, 12 pages.
Gaucher, "New Perspectives in the Industrial Exploration for Native Hydrogen," Elements, Feb. 1, 2020, 16(1):8-9, 2 pages.
Han et al., "Hydrogen-rich gas discovery in continental scientific drilling project of Songliao Basin, Northeast China: new insights into deep Earth exploration," Science Bulletin, May 30, 2022, 67(10):1003-1006, 4 pages.
Jarvie, "Chapter 3—Geochemical Assessment of Unconventional Shale Gas Resource Systems," Fundamentals of Gas Shale Reservoirs, Apr. 10, 2015, pp. 47-69, 23 pages.
Lefeuvre et al., "Native H2 exploration in the western Pyrenean foothills," Geochemistry, Geophysics, Geosystems, Aug. 2, 2021, 20 pages.
Li et al., "Liberation of molecular hydrogen (H2) and methane (CH4) during non-isothermal pyrolysis of shales and coals: Systematics and quantification," International Journal of Coal Geology, 2015, 137:152-164, 13 pages.
Li et al., "Molecular hydrogen (H2) and light hydrocarbon gases generation from marine and lacustrine source rocks during closed-system laboratory pyrolysis experiments," Journal of Analytical and Applied Pyrolysis, Jul. 2017, 126:275-287, 13 pages.
Lorant et al., "Late Generation of Methane from Mature Kerogens," Energy Fuels, Jan. 22, 2002, 16(2):412-427, 16 pages.
Milkov et al., "Geochemistry of shale gases from around the world: Composition, origins, isotope reversals and rollovers, and implications for the exploration of shale plays," Organic Geochemistry, May 2020, 143(103997):1-18, 18 pages.
Milkov, "Molecular hydrogen in surface and subsurface natural gases: Abundance, origins and ideas for deliberate exploration," Earth-Science Reviews, Jul. 2022, 230(104063):1-27, 27 pages.
Prinzhofer et al., "Discovery of a large accumulation of natural hydrogen in Bourakebougou (Mali)," International Journal of Hydrogen Energy, Oct. 18, 2018, 43(42):19315-19326, 12 pages.
Reitsma, "The natural hydrogen field without pressure depletion," GEOExPro, Nov. 3, 2022, retrieved on Jun. 14, 2024, retrieved from URL <https://geoexpro.com/the-natural-hydrogen-field-without-pressure-depletion/>, 6 pages.
Schenk et al., "Chapter 4—Kinetics of petroleum formation and cracking," Petroleum and Basin Evolution, 1997, pp. 231-269, 39 pages.
Smith et al., "Hydrogen exploration: a review of global hydrogen accumulations and implications for prospective areas in NW Europe," Petroleum Geology: North-West Europe and Global Perspectives—Proceedings of the 6th Petroleum Geology Conference, Jan. 1, 2005, pp. 349-358, 10 pages.
Smith, "It's time for explorationists to take hydrogen more seriously," First Break, Apr. 2002, 20(4):246-253, 8 pages.
Stalker et al., "Gold (hydrogen) rush: risks and uncertainties in exploring for naturally occurring hydrogen," The APPEA Journal, May 13, 2022, 62(1):361-380, 20 pages.
Suzuki et al., "Hydrogen gas of organic origin in shales and metapelites," International Journal of Coal Geology, Mar. 15, 2017, 173:227-236, 10 pages.
Sweeney et al., "Evaluation of a simple model of vitrinite reflectance based on Chemical kinetics," AAPG Bulletin, Jan. 1990, 74(10): 1559-1570, 13 pages.
Truche et al., "The quest for native hydrogen: new directions for exploration," Géologues géosciences et société, Oct. 2022, 7 pages.
Vandenbroucke et al., "Kerogen origin, evolution and structure," Organic Geochemistry, May 2007, 38(5):719-833, 115 pages.
Zgonnik, "The occurrence and geoscience of natural hydrogen: A comprehensive review," Earth-Science Reviews, Apr. 2020, 203(103140):1-514, 51 pages.

* cited by examiner

200

| Tube | Sample ID | Temp. | Heating rate (222) | C1 (202) | C2 (204) | C3-C5 (206) | H2 (218) | CO2 (216) | C6-14Sat (208) | C6-14Aro (210) | C15+Sat (212) | C15+Aro (214) | NSO (220) |
|---|---|---|---|---|---|---|---|---|---|---|---|---|---|
| | | *C | *C/h | mg/g | mg/g | mg/g | mg/g | mg/g | mg/g | mg/g | mg/g | mg/g | mg/g |
| 1 | Shale 1-1 | 334 | 20 | 0.08 | 0.03 | 0.03 | 0.00 | 22.38 | 4.10 | 0.58 | 6.59 | 0.32 | 7.44 |
| 2 | Shale 1-2 | 358 | 20 | 0.88 | 0.52 | 0.90 | 0.02 | 29.20 | 6.02 | 0.87 | 8.60 | 0.55 | 13.17 |
| 3 | Shale 1-3 | 382 | 20 | 1.87 | 1.46 | 2.73 | 0.15 | 34.26 | 8.57 | 1.30 | 13.37 | 1.03 | 23.18 |
| ... | Shale 1-.. | ... | 20 | ... | ... | ... | ... | ... | ... | ... | ... | ... | ... |
| ... | Shale 1-.. | ... | 20 | 38.45 | 13.27 | 6.09 | 4.67 | 106.04 | 0.08 | 4.67 | 0.00 | 0.61 | 1.50 |
| 10 | Shale 1-10 | ... | 20 | ... | ... | ... | ... | ... | ... | ... | ... | ... | ... |
| | | | | | | | | | | | | | |
| 11 | Shale 1-11 | 302 | 1 | 0.26 | 0.10 | 0.08 | 0.00 | 13.16 | 4.84 | 0.61 | 6.54 | 0.38 | 10.49 |
| 12 | Shale 1-12 | 325 | 1 | 1.04 | 0.64 | 0.85 | 0.01 | 32.86 | 7.35 | 0.86 | 9.97 | 0.52 | 18.91 |
| 13 | Shale 1-13 | 347 | 1 | 2.20 | 1.83 | 3.48 | 0.06 | 39.82 | 10.22 | 1.57 | 15.46 | 1.04 | 26.25 |
| ... | Shale 1-... | ... | 1 | ... | ... | ... | ... | ... | ... | ... | ... | ... | ... |
| ... | Shale 1-... | ... | 1 | 55.36 | 10.53 | 1.59 | 3.90 | 123.81 | 2.09 | 3.47 | 0.00 | 1.01 | 1.32 |
| 20 | Shale 1-20 | ... | 1 | ... | ... | ... | ... | ... | ... | ... | ... | ... | ... |

*C6-14Sat: saturated C6-C14 compounds in oil fraction*
*C6-C14Aro: aramotatic C6-C14 compounds in oil fraction*
*C15+Sat: saturated C15+ compounds in oil infraction*
*C15+Aro: aromatic C15+ compounds in oil fraction*
*NSO: Nitrogen, Sulfur, Oxgen-compounds*

FIG. 2

IDENTIFYING HYDROGEN SWEET SPOTS IN SUBSURFACE FORMATIONS

TECHNICAL FIELD

This disclosure generally relates to identifying hydrogen sweet spots in subsurface formations.

BACKGROUND

Molecular hydrogen ($H_2$) is an energy-rich gas and clean fuel that produces only heat and water when combusted. $H_2$ can be produced from gasification of coal, steam reforming of natural gas (mainly methane), and electrolysis of water.

SUMMARY

Natural $H_2$ can be generated and produced from subsurface formations. Surface gas survey, mud gas logging, crushed rock samples, downhole and wellhead fluid sampling can detect $H_2$ in various environments with relatively enriched $H_2$ (e.g., $H_2$>6% mol) in some geological settings such as mid-ocean ridges, serpentinites, Precambrian basement, and volcanic/magmatic hydrothermal systems.

Natural $H_2$ in a subsurface formation can be generated from various sources, for example, reduction of water during the oxidation of iron (Fe) minerals (e.g., serpentinization), radiolysis of water due to radioactive decay of uranium, thorium, or potassium, degassing of magma and deep-seated hydrogen from the core and mantle, and biogenic/thermogenic decomposition of organic matter.

This disclosure describes an approach to identifying hydrogen sweet spots (e.g., locations of $H_2$ rich source rock, productive zones) in a subsurface formation. Laboratory pyrolysis experiments can be performed to determine an $H_2$ generation potential of hydrocarbon source rock from the subsurface formation (e.g., a coal/organic-rich shale). Natural $H_2$ can be effectively generated from thermally mature source rock when the source rock has passed peak methane production. The experimental data can be used to determine natural $H_2$ potential in the subsurface formation through kinetic modeling and source rock evaluation. Using the generated data, the sweet spots for natural hydrogen generation can be identified.

Rock samples can be obtained from the subsurface formation. Pyrolysis of the rock samples can be performed to determine amounts of $H_2$ and hydrocarbons that can be generated in the rock samples. Kinetic parameters can be determined based on the pyrolysis data to describe the generation rates of products. The generation of $H_2$ and hydrocarbons in the subsurface formation can be simulated based on the kinetic parameters and the thermal history of the formation. The temperature range and thermal maturity of $H_2$ and hydrocarbon generation can be determined in the simulation. Total organic content (TOC) and thermal maturity data can be measured for the rock samples. Hydrogen sweet spots can be identified in the subsurface formation based on the predicted target maturity data, TOC, and the measured rock sample maturity data.

Implementations of the systems and methods of this disclosure can provide various technical benefits. This approach links laboratory measurements of $H_2$ generation from source rock samples to geologically measurable parameters (e.g., thermal maturity, depth) that can be used to locate the sweet spot in the subsurface formation. The hydrogen sweet spots identified by this approach can be targeted for natural $H_2$ production with reduced cost and carbon footprint as compared with conventional $H_2$ production (e.g., gasification of coal, steam reforming of natural gas, etc.). More natural $H_2$ may be discovered in the well-sealed charged by the $H_2$ generated in the source rock formation during the geological history. This approach can evaluate the total resource potential of $H_2$. A resource potential parameter can be used to map the prospect of natural $H_2$ accumulated in a subsurface formation and reduce risks of $H_2$ exploration in regions with the access to the source rock.

The details of one or more implementations of these systems and methods are set forth in the accompanying drawings and the description below. Other features, objects, and advantages of these systems and methods will be apparent from the description and drawings, and from the claims.

DESCRIPTION OF DRAWINGS

FIG. 2 is a table of hydrocarbon, carbon dioxide, and hydrogen yields from conducting pyrolysis on rock samples.

Like reference symbols in the various drawings indicate like elements.

DETAILED DESCRIPTION

This disclosure describes an approach to identifying hydrogen sweet spots in a subsurface formation. A hydrogen sweet spot can be a location in the subsurface formation that has reached a thermal maturity to produce natural hydrogen gas ($H_2$). Rock samples can be obtained from the subsurface formation (e.g., an organic rich shale or coal formation). Pyrolysis of the rock samples can be performed to determine an amount of $H_2$ that can be generated in the rock samples as compared to the conventional determination of hydrocarbon generation. Kinetic parameters can be determined based on the pyrolysis to describe the generation rates of the products. The generation of $H_2$ and hydrocarbons in the subsurface formation can be simulated based on the kinetic parameters and the thermal history of the formation. The temperature range and thermal maturity of $H_2$ and hydrocarbon generation can be predicted by the simulation. Total organic content (TOC) and thermal maturity data can be measured for the rock samples to determine a current total organic content and rock sample maturity of the subsurface formation. Hydrogen sweet spots can be identified in the subsurface formation based on the predicted maturity, the measured rock sample maturity data, and the total organic content.

Figure 1A:
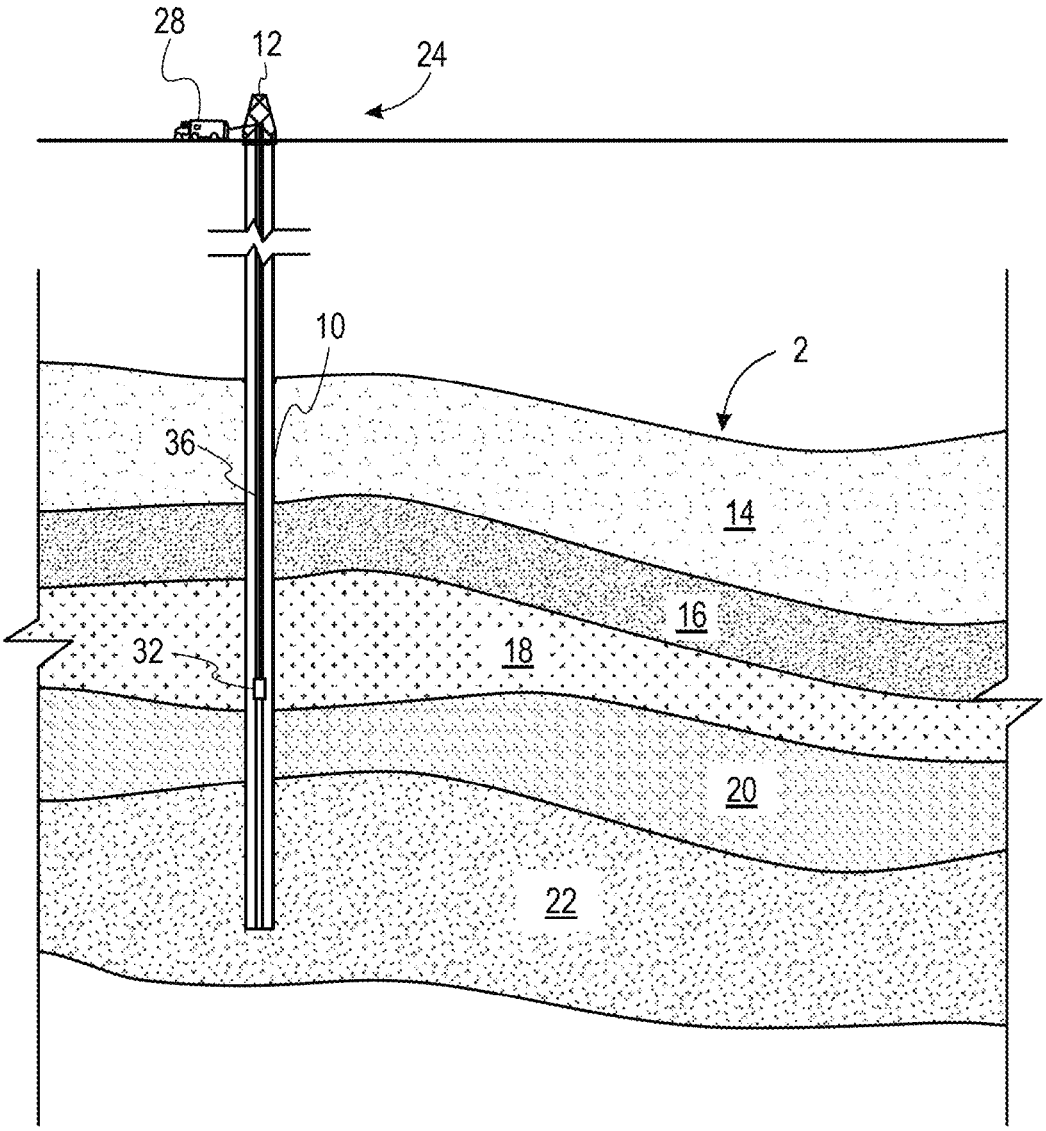
FIG. 1A is a schematic illustrating the stratigraphy and a target subsurface formation.

FIG. 1A illustrates a targeted subsurface formation (e.g., organic-rich shale or coal) 2 in which a wellbore 10 extends downhole from a wellhead 12. The wellbore 10 is a vertical wellbore but other types of wellbores, for example, slanted or horizontal wellbores can also be drilled in the subsurface formation 2. The subsurface formation includes five layers 14, 16, 18, 20, 22. The subsurface formation can include layers with different formation properties (e.g., mineralogy, fluid type, TOC, maturity). Some of the layers may have potential to produce natural $H_2$.

The layers 14-22 in the subsurface formation 2 can be characterized using a wireline operation 24. A control truck 28 lowers a logging tool 32 (e.g., a sidewall coring tool) down the wellbore 10 on a wireline 36. As the logging tool 32 travels downhole, measurements of formations properties are recorded to generate a well log (e.g., resistivity logs, gamma ray logs, bulk density logs, porosity logs, acoustic logs). Using a wireline coring tool, core samples can be obtained in addition to obtaining well logs. A core sample is a usually cylindrical piece of the subsurface formation that is removed by a special drill and brought to the surface. Core samples can be used in pyrolysis experiments and source rock evaluations to determine the potential of $H_2$ generated from the subsurface formation 2. Core samples can be taken from the sidewalls of a drilled well. When sidewall core samples are repeated along the length of the well, the properties measured from the core samples can be compared and correlated with well logging measurements. In the illustrated operation, the data can be recorded at the control truck 28 in real-time. Real-time data are recorded directly against measured cable depth. In some well-logging operations, the data is recorded at the logging tool 32 and downloaded later. In this approach, the downhole data and depth data are both recorded against time. The two data sets are then merged using the common time base to create an instrument response versus depth log.

In the wireline operation 24, the well logging and core sample collection is performed on a wellbore 10 that has already been drilled. In some operations, well logging and rock sample collection is performed while drilling the well using, for example, logging while drilling techniques and collecting drilling cuttings. In these techniques, the logging and core sample tools are integrated into the drill string and the measurements are made in real-time, during drilling rather than using sensors lowered into a well after drilling.

Figure 1B:
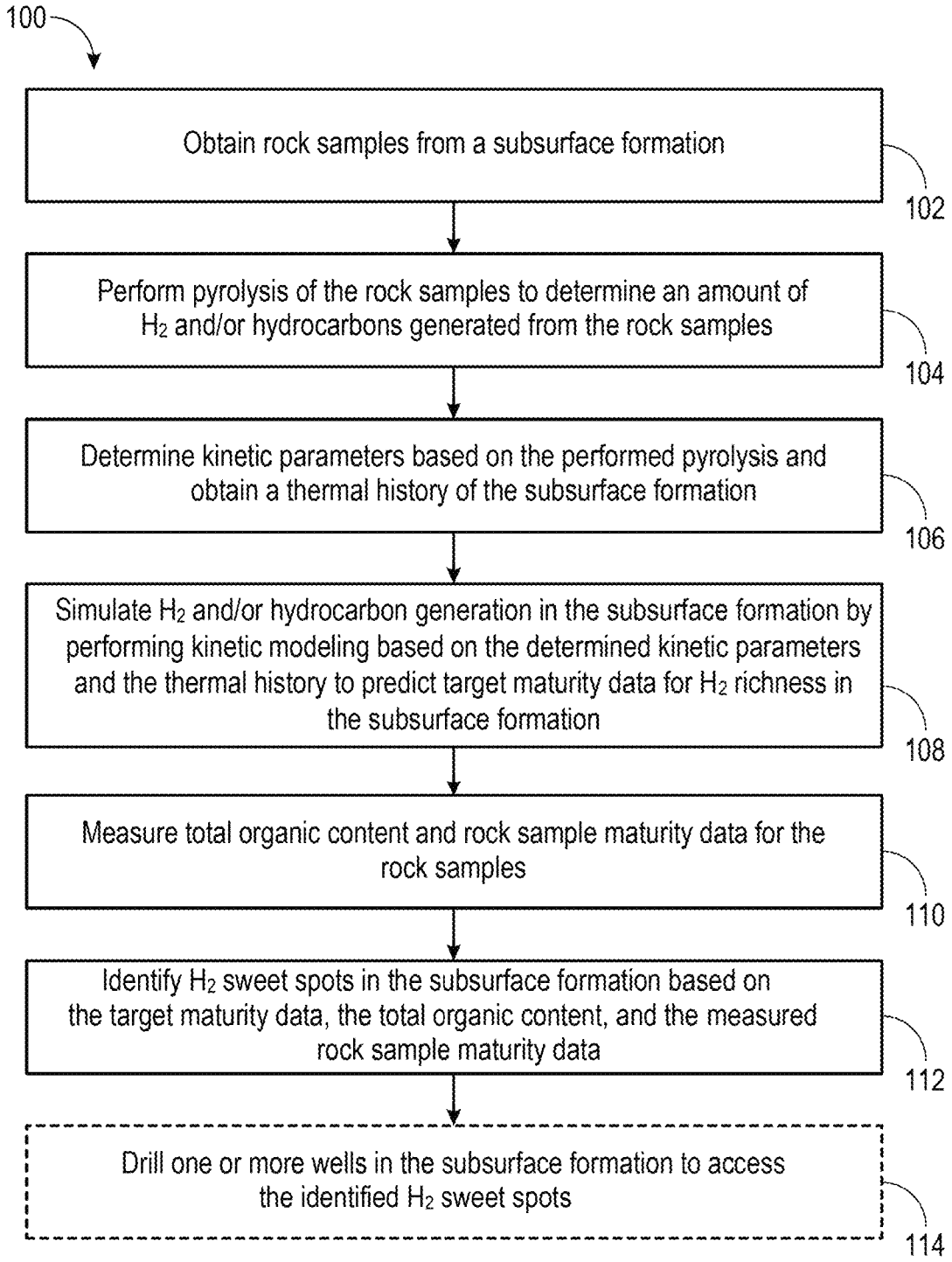
FIG. 1B is a flow chart of a method for identifying hydrogen sweet spots in a subsurface location.

FIG. 1B is a flow chart of a method 100 for identifying natural $H_2$ sweet spots in a subsurface formation. The method 100 includes performing laboratory pyrolysis experiments and source rock evaluation using rock samples from the subsurface formation. Application of the method 100 can assess the resource potential of thermogenic $H_2$ and identify the sweet spots of $H_2$ in the subsurface formation.

Rock samples are obtained from the subsurface formation (step 102). For example, rock samples are obtained from an organic-rich shale or coal subsurface formation in an area of interest. Rock samples can include core samples, sidewall core samples, washed drilling cuttings, and/or preserved outcrop samples.

Pyrolysis of the rock samples is performed to determine amounts of $H_2$ and/or hydrocarbons that can be generated from the rock samples (step 104). Performing pyrolysis includes performing laboratory experiments to simulate hydrocarbon (e.g., gas and oil) and non-hydrocarbon (e.g., $CO_2$, $H_2$) generation from the kerogen of the source rock (e.g., shale/coal). The pyrolysis experiment can be done in an open system (e.g., pyrolysis gas chromatography) or a closed system (e.g., gold-tube pyrolysis) with different heating rates to reach the end of the generation of hydrocarbons and $H_2$ for the rock samples. In open system pyrolysis, the open system expels products of the rock samples and leaves residual kerogen for cracking with increased temperature. In closed system pyrolysis, the closed system retains products produced from the rock samples in the system and keeps kerogen for cracking with secondary cracking of the produced products at higher temperature. The closed system pyrolysis retains and reacts $H_2$ produced during the pyrolysis experiments whereas the open system releases the $H_2$ as it is produced.

The quantity of $H_2$ generated from an open system can be comparable to (or even more than) methane yield. In general, an open system can generate more $H_2$ than a closed system due to, for example, the immediate escape of $H_2$ in the open system, while most of the $H_2$ generated in the closed system can be consumed, for example, in saturating hydrocarbon radicals formed in the cracking of kerogen or bitumen. In geological reality, full open source rock systems can be rare. Source rock in the subsurface formation can be on a spectrum between a semi-open and closed system due to, for example, low permeability and/or thickness of shale. $H_2$ generation in an open pyrolysis system can represent a maximum potential of $H_2$ generated in a hydrocarbon source rock. $H_2$ generation in a closed pyrolysis system can be a conservative estimation of $H_2$ potential in the hydrocarbon source rock.

Produced gas and oil can be collected from the pyrolysis experiment for quantification and compositional analysis. For example, oil, oil fractions, and gas components can be collected and quantified. Quantification can include for example, weighing, liquid chromatography, and gas chromatography. Procedures of the experiments and method for analysis are described in Behar, F., et al. "Thermal cracking of kerogen in open and closed systems: determination of kinetic parameters and stoichiometric coefficients for oil and gas generation," *Organic Geochemistry,* 26(5-6), 321-339, which is incorporated by reference herein in its entirety. Pyrolysis experiments to measure $H_2$ generation can be run for longer times and at higher temperatures than conventional pyrolysis experiments for determining hydrocarbon production. The $H_2$ generation pyrolysis experiments can be run until no additional gas is generated from the kerogen in the rock sample.

FIG. 2 is a table 200 of hydrocarbon 202-214, carbon dioxide 216, $H_2$ 218 and other compound 220 yields from conducting pyrolysis on rock samples. Gold tube pyrolysis was performed to simulate hydrocarbon and $H_2$ generation from 20 aliquots of a shale sample. Two heating rates 222 (1° C./hour, 20° C./hour) were used in the experiment. Oil, oil fractions, and gas components were collected after the temperature program was finished for each aliquot. The products were quantified by weighing, liquid chromatography, and gas chromatography. The data shown in table 200 can be used to determine kinetic parameters to describe hydrocarbon and $H_2$ generation in the subsurface formation.

Returning to FIG. 1B, the method 100 proceeds by determining kinetic parameters based on the pyrolysis data and obtaining a thermal history of the subsurface formation (step 106). For example, the conversion of kerogen under thermal stress can be regarded as a series of irreversible reactions controlled by first-order chemical kinetics, which can be described by an Arrhenius equation:

$$k=Ae^{-Ea/RT} \quad \text{Eq. 1}$$

where k is the reaction rate describing the change in molar mass of the reactant with respect to time; A is the frequency (pre-exponential) factor describing the number of potential elementary reactions per unit time; $E_a$ is the activation energy (e.g., the energy barrier that must be exceeded in order for a reaction to occur); R is the gas constant equal to 8.31447 Ws/mol/K; Tis the reaction temperature (in Kelvin, K); and e is the base of the natural logarithm approximately equal to 2.718.

The Arrhenius equation theoretically determines the rate (k) of the transformation of kerogen to hydrocarbon and non-hydrocarbon (including $H_2$) as a response to temperature (T) increase during the burial history (t) of the source rock. The kinetic parameters, activation energy ($E_a$) and frequency factor (A) can be inputs for a source rock in basin modeling to quantify generation, retention and expulsion of petroleum and to determine the timing of these processes. There are, for example, three types of kinetics for kerogen conversion with different details in products: bulk kinetics which converts kerogen into hydrocarbon; oil and gas kinetics which converts kerogen to oil and gas; and compositional kinetics which converts kerogen to multiple components (see, e.g., table 200).

The pyrolysis data are processed, for example, by a data processing system using kinetics analysis software or manual regression, to determine the kinetic parameters $E_a$ and A. A discrete distribution of $E_a$ and a common A can be determined for each product produced during pyrolysis.

Figure 3:
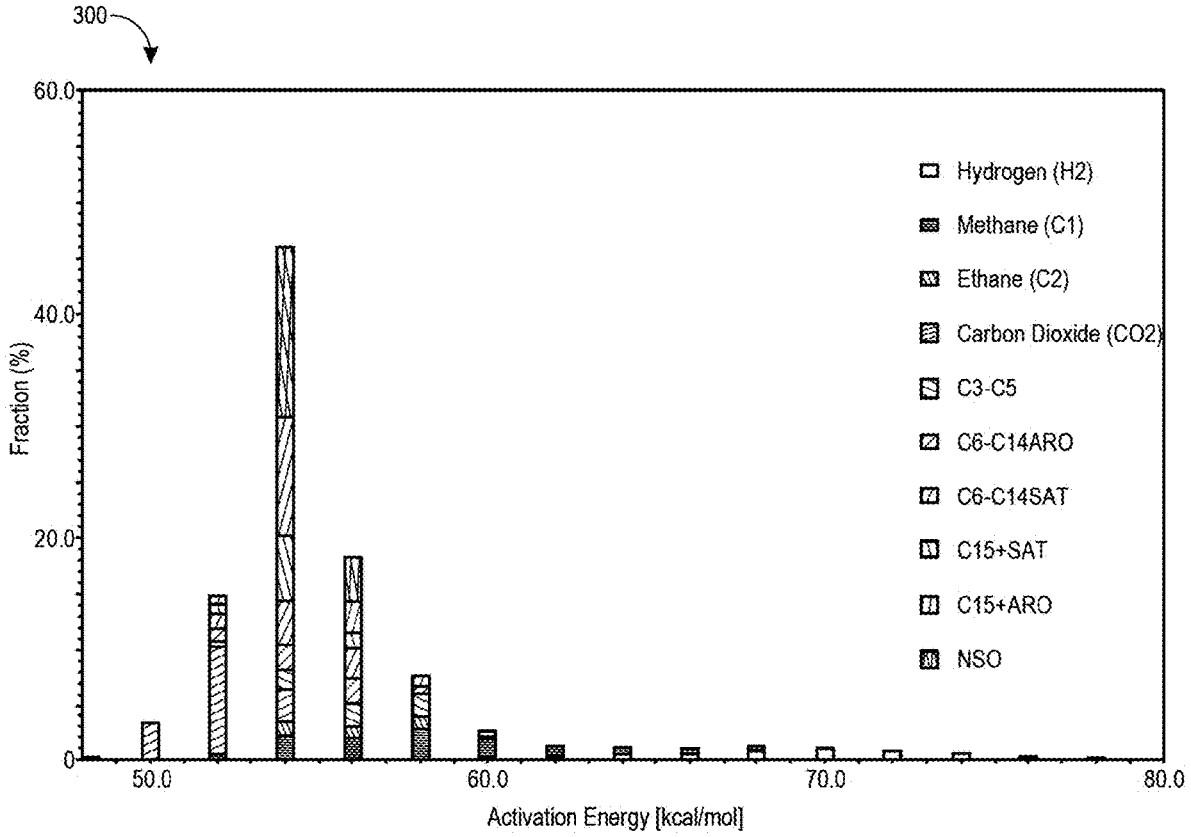
FIG. 3 is a plot of the distribution of activation energy for products generated from rock samples in a pyrolysis experiment.

FIG. 3 shows a plot 300 of the distribution of activation energy ($E_a$) for the products measured in the pyrolysis experiment shown in table 200. In general, $H_2$ has a higher activation energy (e.g., a higher temperature or a longer time is required to generate $H_2$) than the other produced components in this example. The higher activation energy leads to exploring reservoirs with higher maturity to locate source rock for $H_2$ production. To reduce dilution of $H_2$ by hydrocarbons, the $H_2$ sweet spot may be located in a formation that has passed a critical maturity (e.g., a formation where the $H_2$ rate is greater than the methane rate). The maturity of a formation can be mapped based on measured maturity data (e.g., using core and/or cuttings samples) or basin modelling can indicate the depth of the critical maturity, and the $H_2$ sweet spot can be at depths greater than the location of the critical maturity since maturity generally increases with depth.

Returning to FIG. 1B, the method 100 continues by simulating $H_2$ and/or hydrocarbon generation in the subsurface formation by performing kinetic modeling based on the determined kinetic parameters and the thermal history to predict target maturity data for $H_2$ richness in the subsurface formation (step 108). For example, the determined kinetic parameters (e.g., compositional kinetic parameters) are loaded into a basin model. With a geological heating rate (e.g., 2° C. per million years (Ma)), the generation of oil, hydrocarbon gases, and $H_2$ can be simulated, providing the generation rates, timing, and yields for all components in the geological history of the source rock.

$H_2$ gas can be generated by processes such as aromatization, annulation, or char gasification during kerogen maturation. These processes require high temperatures which occur in mature source rock in the geological history. $H_2$ can be generated during the kerogen maturation as well as consumed in hydrocarbon generation. The aromatization and condensation of kerogen structures liberates $H_2$ for the reduction of alkyl chains cleaved from kerogen at C—O and C—C bonds. Ring-opening reactions require the addition of $H_2$ to yield methane and other hydrocarbon gases. In the closed system, there would be a competitive consumption of the $H_2$ residing in kerogen by the formation of methane over $H_2$.

A threshold for effective $H_2$ generation can be the generation rate of $H_2$ exceeding C2 (ethane). Beyond this threshold, a relatively high temperature/maturity can promote $H_2$ generation reactions in company with gradually exhausted free radical reactions for the formation of hydrocarbon gases. When the generation rate of $H_2$ exceeds methane, the formation of $H_2$ can capture the residual hydrogen in the kerogen. The dominant $H_2$ generation, with less and less dilution by methane generation as temperature/maturity increase, can accumulate in-situ in the subsurface formation to form $H_2$ sweet spots in the source rock reservoir (e.g., organic-rich shale or coal).

Additionally, there is a pragmatic consideration for the generation rate of $H_2$ over methane as a control for $H_2$ richness. For example, in a global dataset, shale gas exploration and production targeted on hydrocarbon gas dominated by methane. The occurrence of methane can be unfavorable for the formation of $H_2$. In some examples, an organic-rich shale with active hydrocarbon generation or a petroleum reservoir with active hydrocarbon cracking can be considered a sink of $H_2$. In samples from a formation with dominant methane production, few samples show traces of $H_2$, and those few samples include small amounts of $H_2$.

In some implementations, the temperature in a heating process (e.g., 2°/h, 2° C./Ma) can be converted to a commonly used proxy of thermal maturity, vitrinite reflectance (Ro). For example, an Easy % Ro model can be used to convert the extent of heating to Ro (Sweeney and Burnham, 1990, "Evaluation of a simple model of vitrinite reflectance based on chemical kinetics." *AAPG bulletin,* 74(10), 1559-1570). A regression line based on the Ro calculation describes the relationship between the temperature and the thermal maturity (Ro) under a certain heating rate. Ro values can be predicted for effective $H_2$ generation, dominate $H_2$ generation and peak $H_2$ generation to define the target maturity for $H_2$ richness. In some implementations, other proxies for thermal maturity can be used.

Figure 4:
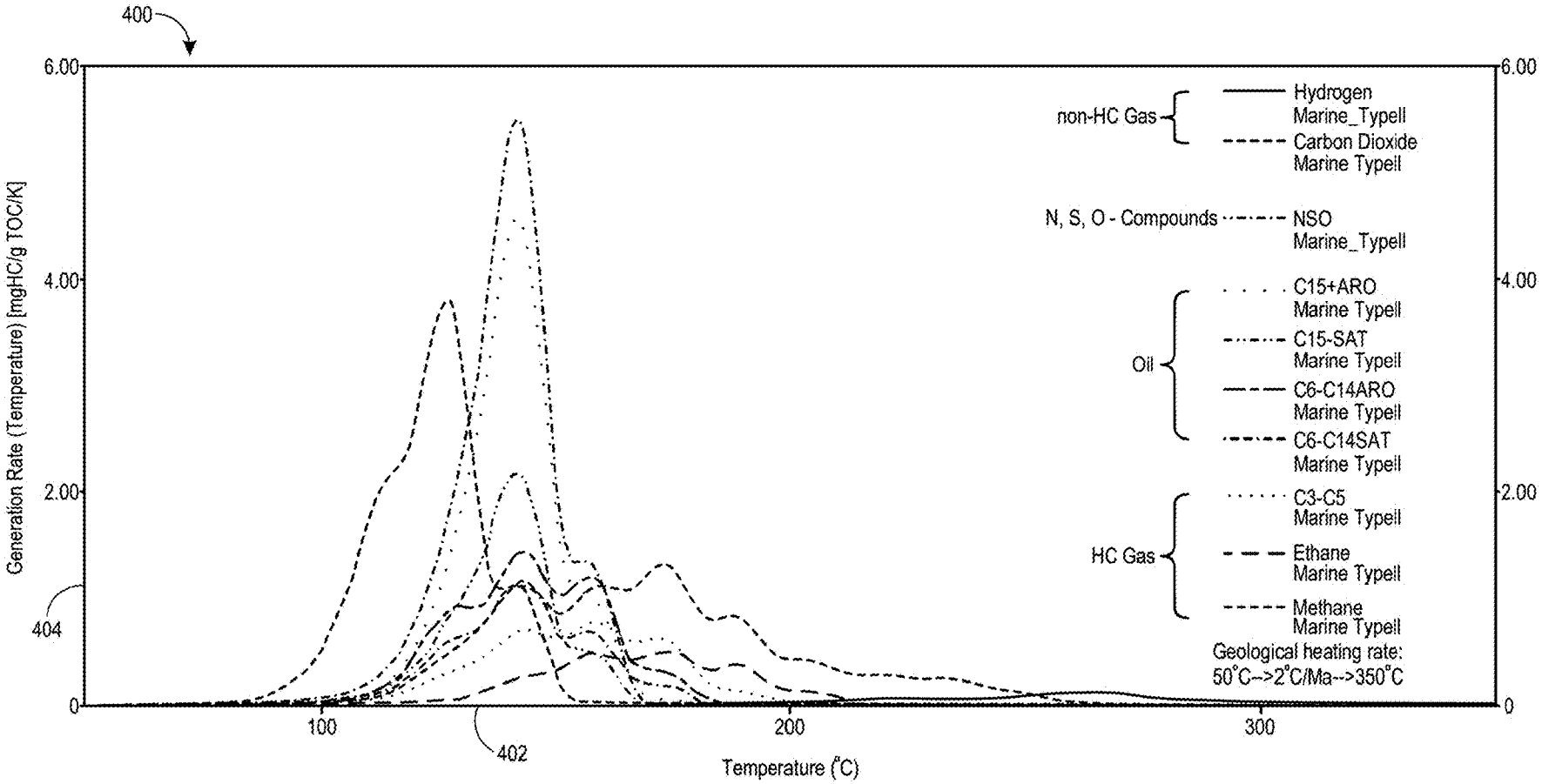
FIG. 4 is a plot of generation rates of products obtained during kinetic modelling to simulate $H_2$ and hydrocarbon generation in geological situation.

FIG. 4 is a plot 400 showing curves of generation rates for products obtained by simulating hydrocarbon and non-hydrocarbon generation in a source rock using kinetic modeling with an assumed geological heating rate of 2° C./Ma. The x-axis 402 shows temperature, and the y-axis 404 shows generation rate. The x-axis can be converted to time via the heating rate to determine the timing of the generation of the products. By integrating the generation rate curves with respect to time, the total potential (e.g., accumulative generation) of each product (methane, $H_2$, etc.) can be estimated.

Figure 5:
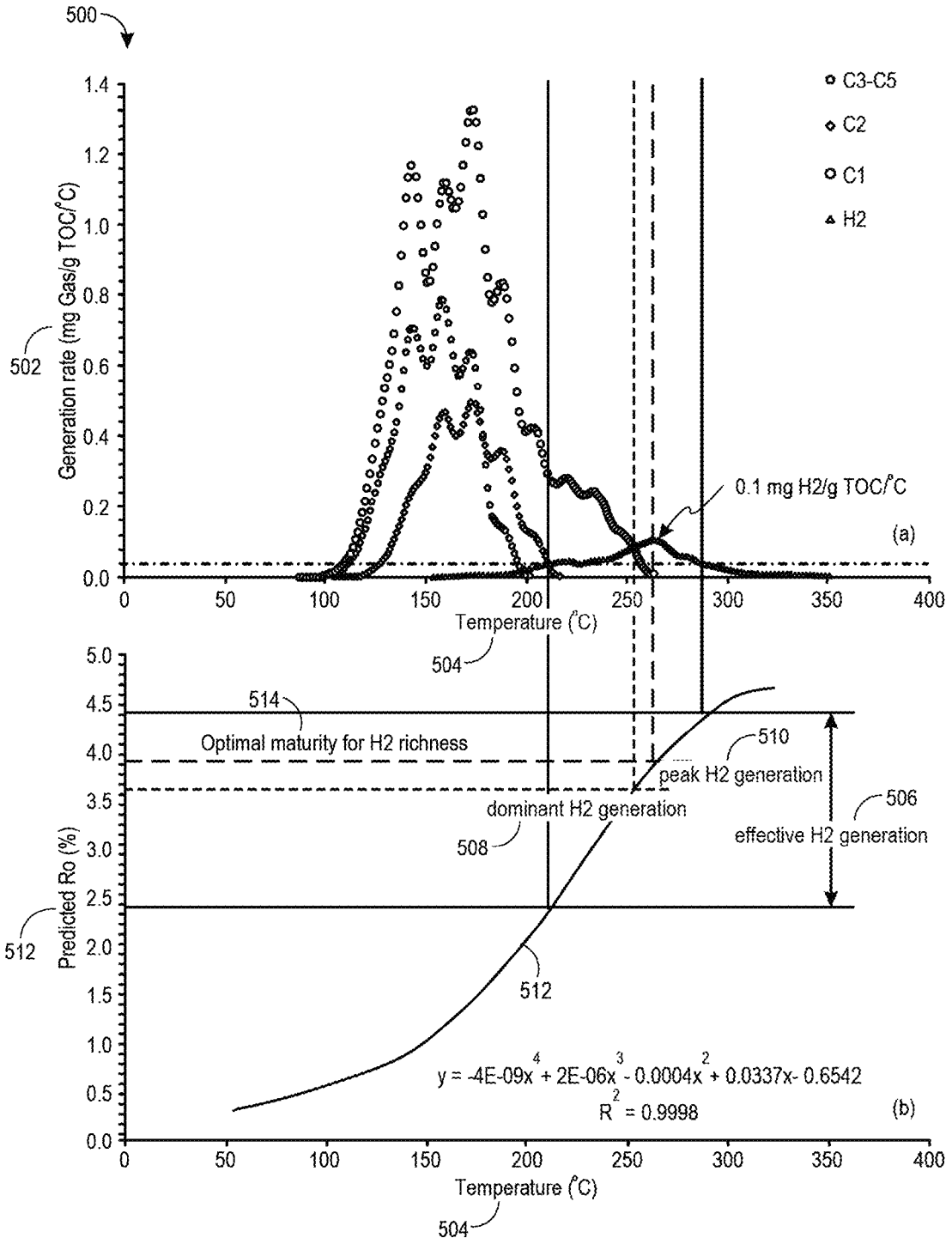
FIG. 5 is a composite plot showing the relationship among generation rates, temperature and maturity based on the kinetic modelling.

FIG. 5 is a composite plot 500 showing generation rates 502 of methane, C2, C3-C5, and $H_2$ versus temperature 504 based on kinetic modeling. The generation rate of $H_2$ exceeding C2 is a threshold for effective $H_2$ generation 506 (>212° C.). The generation rate of $H_2$ exceeding methane indicates dominant $H_2$ generation 508 (>253° C.). The peak $H_2$ generation 510 occurs at ~260° C. The target temperature range for $H_2$ richness is 253-287° C. in the thermal history (2° C./Ma). The top end of the target temperature range can be determined based on the intersection of the $H_2$ generation curve and the horizontal line passing through the point where the $H_2$ production rate is equal to the ethane production rate. The temperature can be converted to a thermal maturity proxy, Ro 512. In this example, the target maturity (Ro) window 514 is 3.6-4.4%.

Returning to FIG. 1B, the method 100 proceeds by measuring total organic content (TOC) and rock sample maturity data for the rock samples (step 110). For example, samples of organic-rich shale or coal can be taken from wells in the area of interest. The rock samples can be analyzed using tools such as Rock-Eval, a hydrocarbon analyzer with kinetics (HAWK), a source rock analyzer (SRA), and organic petrography analyses. These analyses can provide TOC value and volumetric estimation of source rock for $H_2$ resource assessment. These analyses provide insight into the current state of the subsurface formation. Depth profiles of measured Ro for wells in the subsurface formation can be generated to locate the target zone for $H_2$ generation and in-situ accumulation in the subsurface formation (e.g., shale/coal play).

The $H_2$ resource potential can be evaluated based on the peak $H_2$ generation. An $H_2$ resource potential parameter (mg $H_2$/g TOC) can be determined based on the simulation. For example, the peak $H_2$ generation rate 510 is 0.1 mg/g TOC/° C. (1.1125 ml/g TOC/° C. at standard temperature and pressure (STP)) for the sample in the kinetic modeling. Integrating the area under the generation rate curve within the target temperature range for $H_2$ generation can provide an estimation of the $H_2$ resource potential (mg $H_2$/g TOC) in the target zone of the subsurface formation. The integration of the whole $H_2$ generation window (170-345° C.) represents the total $H_2$ resource potential (mg $H_2$/g TOC) of the subsurface formation at that location. The resource for an area of interest in the subsurface formation can be calculated by a volumetric equation:

$$\text{H2 Resource} = \text{Resource Potential} * \text{Average TOC} * \text{Thickness} * \text{Area} \quad \text{Eq. 2}$$

An open system pyrolysis can generate much more $H_2$ than a closed system as discussed earlier. Therefore, the numbers of peak generation rate and resource potential obtained and simulated in a closed system can represent a conservative estimation for $H_2$ resource potential in the subsurface formation.

$H_2$ sweet spots are identified in the subsurface formation based on the predicted target maturity data, the TOC, and the measured rock sample maturity data (step 112). $H_2$ sweet spots correspond to the locations in the subsurface formation that have the identified target maturity.

In some implementations, one or more wells can be drilled in the subsurface formation to access the $H_2$ in the identified sweet spots (step 114). For example, one or more wells can be drilled in the subsurface formation at locations near an exploration well that would be expected to have similar thermal maturity and TOC. The wells can be drilled to a depth at which the identified $H_2$ sweet spot can be accessed. In some implementations, a horizontal well can be drilled within the sweet spot sot produce $H_2$ from the sweet spot. Cuttings and/or core samples taken from the one or more wells can be analyzed to measure the Ro value and validate the identified location of the $H_2$ sweet spot in the subsurface formation.

In some implementations, a data processing system controls drilling equipment to drill the one or more wells in the subsurface based on the identified $H_2$ sweet spots. For example, the data processing system can control the depth of the well or the direction of the well to access the identified $H_2$ sweet spot. In some implementations, the data processing system can control production equipment to produce the $H_2$ from the $H_2$ sweet spots.

Figure 6:
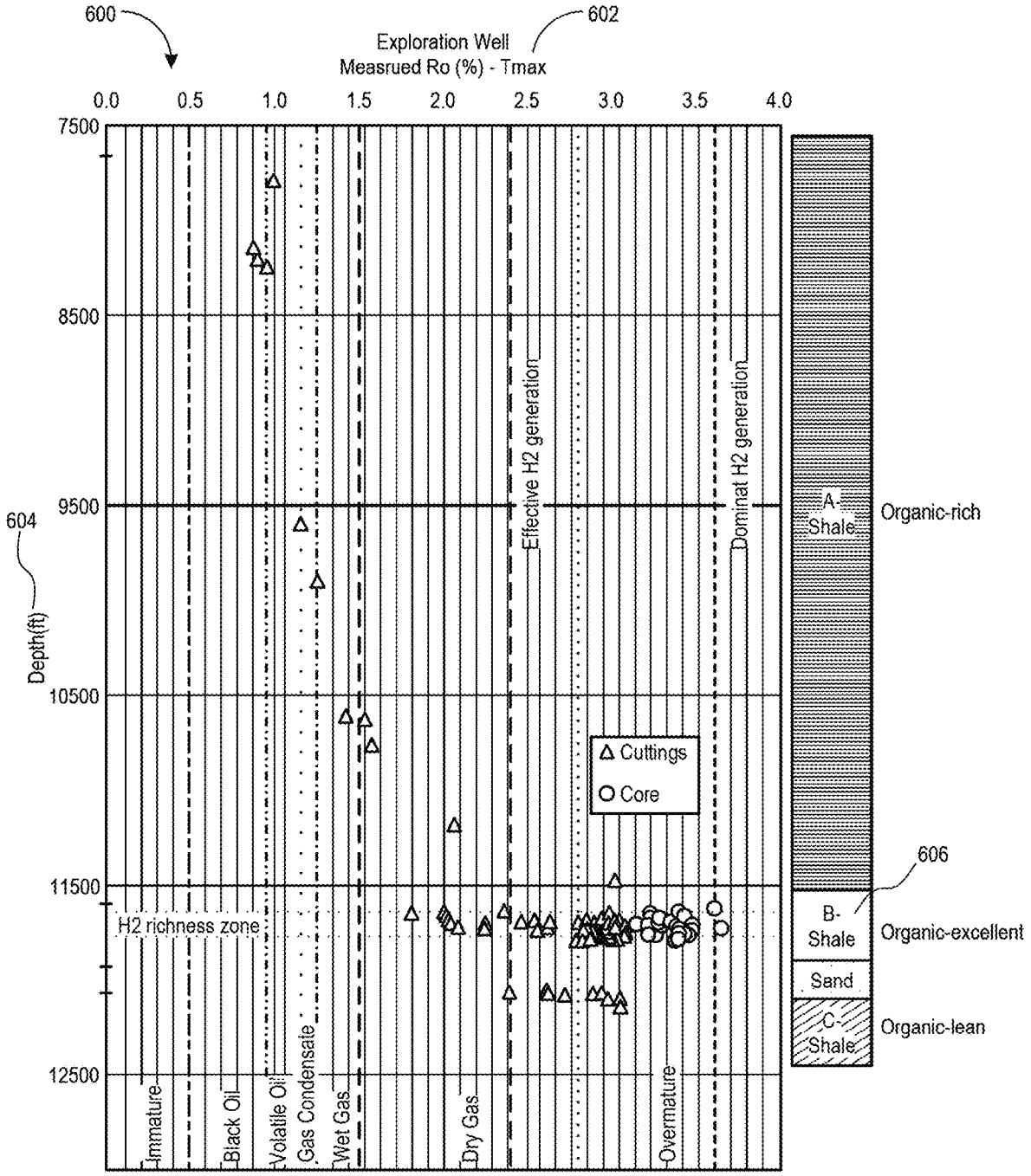
FIG. 6 is a plot identifying an $H_2$ sweet spot for an exploration well using maturity data.

FIG. 6 is a plot 600 from an exploration well showing measured Ro 602 versus depth 604. Cuttings and core samples were taken from a clastic succession in the exploration well. The cuttings and core samples were analyzed by Rock-Eval to obtain Tmax (the temperature at which the maximum rate of hydrocarbon generation occurs in a kerogen sample during pyrolysis analysis) data. Tmax, as a proxy of thermal maturity, was then converted to Ro. As shown in FIG. 6, some of the Ro values measured on cuttings reach the threshold (2.4%) of effective $H_2$ generation determined in FIG. 5; and more reliable Ro values measured on core samples exceed the threshold. Two Ro data from core samples reaching the dominant $H_2$ generation (3.6%) may indicate the sweet spot of $H_2$ in the organic-excellent shale 606 (B-Shale).

Implementations of method 100 can benefit from systematic sampling of the subsurface formation in areas of interest. For example, taking systematic samples from organic-rich shale or coal crossing thermal maturities in the area of interest. High resolution sampling (e.g., 3 ft per one sample) in the target formation can better define the depth of the $H_2$ sweet spot. Selecting the most immature sample and the most mature sample for pyrolysis experiment and kinetic modeling can provide upper and lower bounds on the $H_2$ resource potential. Repeating steps 110-112 for multiple wells in the subsurface formation with available source rock samples and correlating the wells with one another can generate a cross section or 3D model of the $H_2$ potential in the subsurface formation and map the location of sweet spots in the area of interest.

Figure 7:
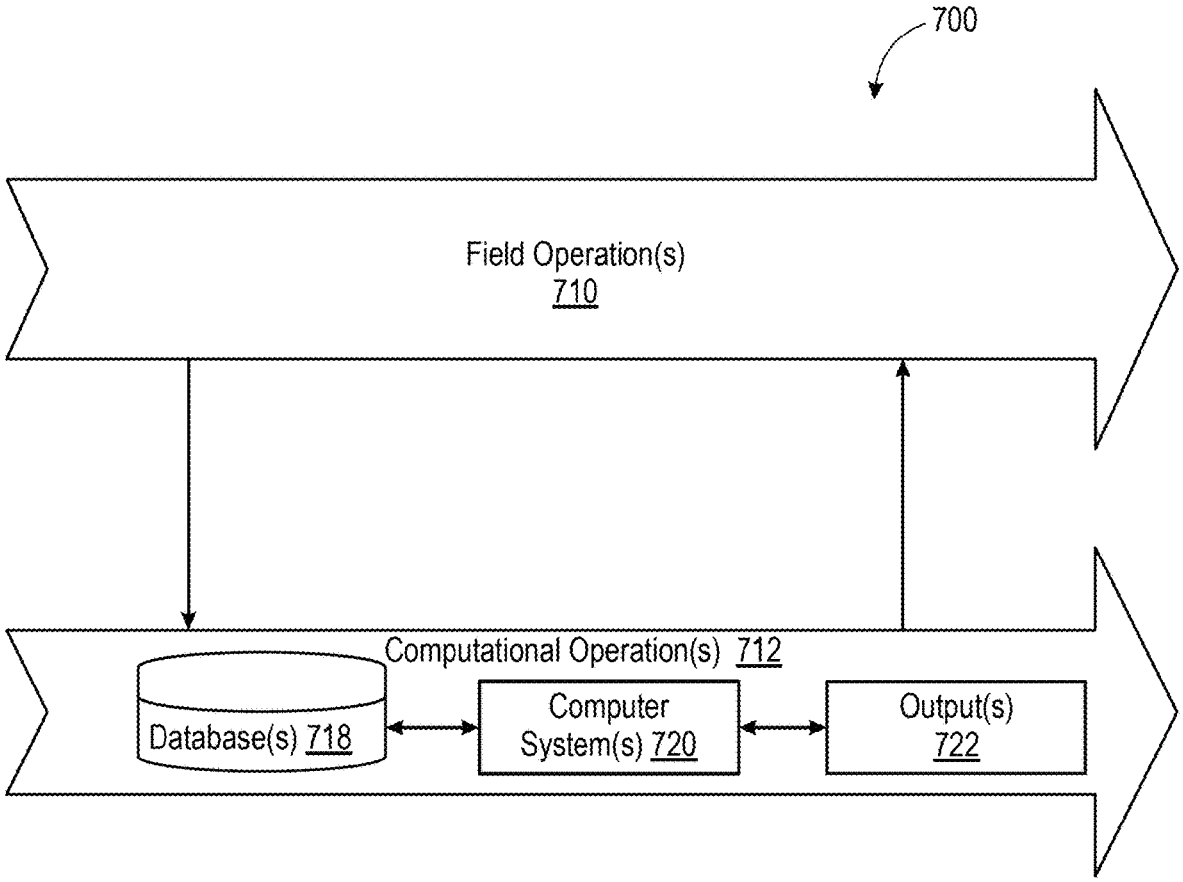
FIG. 7 illustrates $H_2$ and/or hydrocarbon production operations that include field operations and computational operations, according to some implementations.

FIG. 7 illustrates $H_2$ and/or hydrocarbon production operations 700 that include both one or more field operations 710 and one or more computational operations 712, which exchange information and control exploration for the production of $H_2$ and/or hydrocarbons. In some implementations, outputs of techniques of the present disclosure (e.g., the method 300) can be performed before, during, or in combination with the hydrocarbon production operations 700, specifically, for example, either as field operations 710 or computational operations 712, or both.

Examples of field operations 710 include forming/drilling a wellbore, hydraulic fracturing, producing through the wellbore, injecting fluids (such as water) through the wellbore, to name a few. In some implementations, methods of the present disclosure can trigger or control the field operations 710. For example, the methods of the present disclosure can generate data from hardware/software including sensors and physical data gathering equipment (e.g., seismic sensors, well logging tools, flow meters, and temperature and pressure sensors). The methods of the present disclosure can include transmitting the data from the hardware/software to the field operations 710 and responsively triggering the field operations 710 including, for example, generating plans and signals that provide feedback to and control physical components of the field operations 710. Alternatively, or in addition, the field operations 710 can trigger the methods of the present disclosure. For example, implementing physical components (including, for example, hardware, such as sensors) deployed in the field operations 710 can generate plans and signals that can be provided as input or feedback (or both) to the methods of the present disclosure.

Examples of computational operations 712 include one or more computer systems 720 that include one or more processors and computer-readable media (e.g., non-transitory computer-readable media) operatively coupled to the one or more processors to execute computer operations to perform the methods of the present disclosure. The computational operations 712 can be implemented using one or more databases 718, which store data received from the field operations 710 and/or generated internally within the computational operations 712 (e.g., by implementing the methods of the present disclosure) or both. For example, the one or more computer systems 720 process inputs from the field operations 710 to assess conditions in the physical world, the outputs of which are stored in the databases 718. For example, seismic sensors of the field operations 710 can be used to perform a seismic survey to map subterranean features, such as facies and faults. In performing a seismic survey, seismic sources (e.g., seismic vibrators or explosions) generate seismic waves that propagate in the earth and seismic receivers (e.g., geophones) measure reflections generated as the seismic waves interact with boundaries between layers of a subsurface formation. The source and received signals are provided to the computational operations 712 where they are stored in the databases 718 and analyzed by the one or more computer systems 720.

In some implementations, one or more outputs 722 generated by the one or more computer systems 720 can be provided as feedback/input to the field operations 710 (either as direct input or stored in the databases 718). The field operations 710 can use the feedback/input to control physical components used to perform the field operations 710 in the real world.

For example, the computational operations 712 can process the seismic data to generate three-dimensional (3D) maps of the subsurface formation. The computational operations 712 can use these 3D maps to provide plans for locating and drilling exploratory wells. In some operations, the exploratory wells are drilled using logging-while-drilling (LWD) techniques which incorporate logging tools into the drill string. LWD techniques can enable the computational operations 712 to process new information about the formation and control the drilling to adjust to the observed conditions in real-time.

The one or more computer systems 720 can update the 3D maps of the subsurface formation as information from one exploration well is received and the computational operations 712 can adjust the location of the next exploration well based on the updated 3D maps. Similarly, the data received from production operations can be used by the computational operations 712 to control components of the production operations. For example, production well and pipeline data can be analyzed to predict slugging in pipelines leading to a refinery and the computational operations 712 can control machine operated valves upstream of the refinery to reduce the likelihood of plant disruptions that run the risk of taking the plant offline.

In some implementations of the computational operations 712, customized user interfaces can present intermediate or final results of the above-described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or app), or at a central processing facility.

The presented information can include feedback, such as changes in parameters or processing inputs, that the user can select to improve a production environment, such as in the exploration, production, and/or testing of petrochemical processes or facilities. For example, the feedback can include parameters that, when selected by the user, can cause a change to, or an improvement in, drilling parameters (including drill bit speed and direction) or overall production of a gas or oil well. The feedback, when implemented by the user, can improve the speed and accuracy of calculations, streamline processes, improve models, and solve problems related to efficiency, performance, safety, reliability, costs, downtime, and the need for human interaction.

In some implementations, the feedback can be implemented in real-time, such as to provide an immediate or near-immediate change in operations or in a model. The term real-time (or similar terms as understood by one of ordinary skill in the art) means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second (s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart or are located in different countries or other jurisdictions.

Figure 8:
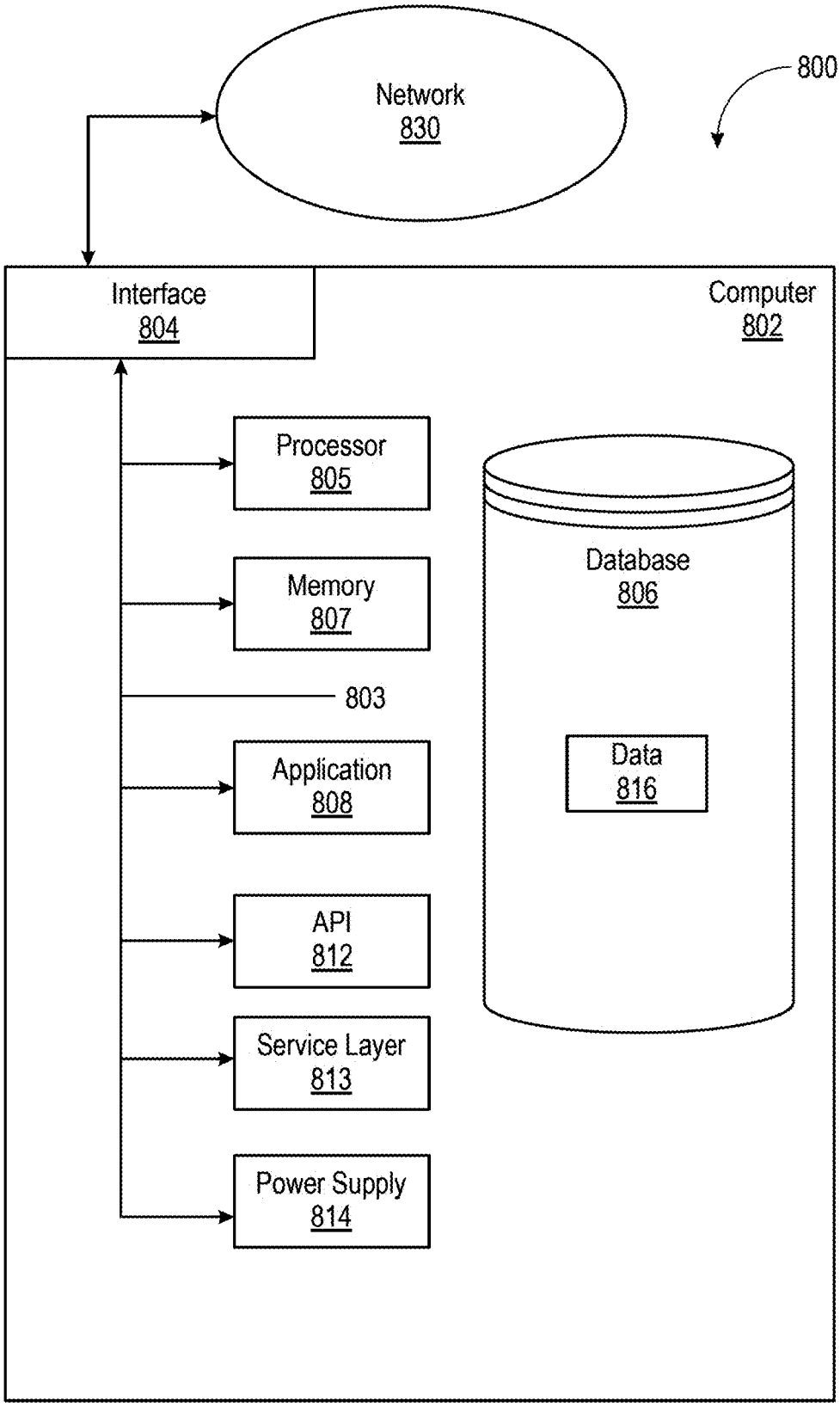
FIG. 8 is a block diagram illustrating an example computer system used to provide computational functionalities associated with described algorithms, methods, functions, processes, flows, and procedures according to some implementations of the present disclosure.

FIG. 8 is a block diagram of an example computer system 800 used to provide computational functionalities associated with described algorithms, methods, functions, processes, flows, and procedures described in the present disclosure, according to some implementations of the present disclosure. The illustrated computer 802 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 802 can include input devices such as keypads, keyboards, and touch screens that can accept user information. Also, the computer 802 can include output devices that can convey information associated with the operation of the computer 802. The information can include digital data, visual data, audio information, or a combination of information. The information can be presented in a graphical user interface (UI) (or GUI).

The computer 802 can serve in a role as a client, a network component, a server, a database, a persistency, or components of a computer system for performing the subject matter described in the present disclosure. The illustrated computer 802 is communicably coupled with a network 830. In some implementations, one or more components of the computer 802 can be configured to operate within different environments, including cloud-computing-based environments, local environments, global environments, and combinations of environments.

At a high level, the computer 802 is an electronic computing device operable to receive, transmit, process, store, and manage data and information associated with the described subject matter. According to some implementations, the computer 802 can also include, or be communicably coupled with, an application server, an email server, a web server, a caching server, a streaming data server, or a combination of servers.

The computer 802 can receive requests over network 830 from a client application (for example, executing on another computer 802). The computer 802 can respond to the received requests by processing the received requests using software applications. Requests can also be sent to the computer 802 from internal users (for example, from a command console), external (or third) parties, automated applications, entities, individuals, systems, and computers.

Each of the components of the computer 802 can communicate using a system bus 803. In some implementations, any or all of the components of the computer 802, including hardware or software components, can interface with each other or the interface 804 (or a combination of both), over the system bus 803. Interfaces can use an application programming interface (API) 812, a service layer 813, or a combination of the API 812 and service layer 813. The API 812 can include specifications for routines, data structures, and object classes. The API 812 can be either computer-language independent or dependent. The API 812 can refer to a complete interface, a single function, or a set of APIs.

The service layer 813 can provide software services to the computer 802 and other components (whether illustrated or not) that are communicably coupled to the computer 802. The functionality of the computer 802 can be accessible for all service consumers using this service layer. Software services, such as those provided by the service layer 813, can provide reusable, defined functionalities through a defined interface. For example, the interface can be software written in JAVA, C++, or a language providing data in extensible markup language (XML) format. While illustrated as an integrated component of the computer 802, in alternative implementations, the API 812 or the service layer 813 can be stand-alone components in relation to other components of the computer 802 and other components communicably coupled to the computer 802. Moreover, any or all parts of the API 812 or the service layer 813 can be implemented as child or sub-modules of another software module, enterprise application, or hardware module without departing from the scope of the present disclosure.

The computer 802 includes an interface 804. Although illustrated as a single interface 804 in FIG. 8, two or more interfaces 804 can be used according to particular needs, desires, or particular implementations of the computer 802 and the described functionality. The interface 804 can be used by the computer 802 for communicating with other systems that are connected to the network 830 (whether illustrated or not) in a distributed environment. Generally, the interface 804 can include, or be implemented using, logic encoded in software or hardware (or a combination of software and hardware) operable to communicate with the network 830. More specifically, the interface 804 can include software supporting one or more communication protocols associated with communications. As such, the network 830 or the interface's hardware can be operable to communicate physical signals within and outside of the illustrated computer 802.

The computer 802 includes a processor 805. Although illustrated as a single processor 805 in FIG. 8, two or more processors 805 can be used according to particular needs, desires, or particular implementations of the computer 802 and the described functionality. Generally, the processor 805 can execute instructions and can manipulate data to perform the operations of the computer 802, including operations using algorithms, methods, functions, processes, flows, and procedures as described in the present disclosure.

The computer 802 also includes a database 806 that can hold data for the computer 802 and other components connected to the network 830 (whether illustrated or not). For example, database 806 can hold data 816 (e.g., resistivity data). For example, database 806 can be an in-memory, conventional, or a database storing data consistent with the present disclosure. In some implementations, database 806 can be a combination of two or more different database types (for example, hybrid in-memory and conventional databases) according to particular needs, desires, or particular implementations of the computer 802 and the described functionality. Although illustrated as a single database 806 in FIG. 8, two or more databases (of the same, different, or combination of types) can be used according to particular needs, desires, or particular implementations of the computer 802 and the described functionality. While database 806 is illustrated as an internal component of the computer 802, in alternative implementations, database 806 can be external to the computer 802.

The computer 802 also includes a memory 807 that can hold data for the computer 802 or a combination of components connected to the network 830 (whether illustrated or not). Memory 807 can store any data consistent with the present disclosure. In some implementations, memory 807 can be a combination of two or more different types of memory (for example, a combination of semiconductor and magnetic storage) according to particular needs, desires, or particular implementations of the computer 802 and the described functionality. Although illustrated as a single memory 807 in FIG. 8, two or more memories 807 (of the same, different, or combination of types) can be used according to particular needs, desires, or particular implementations of the computer 802 and the described functionality. While memory 807 is illustrated as an internal component of the computer 802, in alternative implementations, memory 807 can be external to the computer 802.

The application 808 can be an algorithmic software engine providing functionality according to particular needs, desires, or particular implementations of the computer 802 and the described functionality. For example, application 808 can serve as one or more components, modules, or applications. Further, although illustrated as a single application 808, the application 808 can be implemented as multiple applications 808 on the computer 802. In addition, although illustrated as internal to the computer 802, in alternative implementations, the application 808 can be external to the computer 802.

The computer 802 can also include a power supply 814. The power supply 814 can include a rechargeable or non-rechargeable battery that can be configured to be either user- or non-user-replaceable. In some implementations, the power supply 814 can include power-conversion and management circuits, including recharging, standby, and power management functionalities. In some implementations, the power-supply 814 can include a power plug to allow the computer 802 to be plugged into a wall socket or a power source to, for example, power the computer 802 or recharge a rechargeable battery.

There can be any number of computers 802 associated with, or external to, a computer system containing computer 802, with each computer 802 communicating over network 830. Further, the terms "client," "user," and other appropriate terminology can be used interchangeably, as appropriate, without departing from the scope of the present disclosure. Moreover, the present disclosure contemplates that many users can use one computer 802 and one user can use multiple computers 802.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of implementations of these systems and methods have been described. Nevertheless, it will be understood that various modifications may be made without departing from the spirit and scope of this disclosure. Accordingly, other implementations are within the scope of the following claims.

EXAMPLES

In an example implementation, a method for identifying natural hydrogen sweet spots in a subsurface formation includes obtaining rock samples from the subsurface formation; performing pyrolysis of the rock samples to determine an amount of hydrogen generated in the rock samples; determining kinetic parameters based on the performed pyrolysis and a thermal history of the subsurface formation; simulating hydrogen generation in the subsurface formation based on the determined kinetic parameters and the thermal history to predict target maturity data for hydrogen richness in the subsurface formation; measuring total organic content and rock sample maturity data for the rock samples; and identifying hydrogen sweet spots in the subsurface formation based on the target maturity data, the total organic content, and the measured rock sample maturity data.

An aspect combinable with the example implementation includes in response to identifying hydrogen sweet spots, drilling one or more wells in the subsurface formation to access the hydrogen sweet spots.

Another aspect combinable with any of the previous aspects includes controlling production equipment to produce hydrogen from the one or more wells.

Another aspect combinable with any of the previous aspects includes measuring thermal maturity of cuttings or core samples taken from the one or more wells to validate the identified hydrogen sweet spots.

In another aspect combinable with any of the previous aspects, the subsurface formation includes an organic rich shale formation or a coal formation.

Another aspect combinable with any of the previous aspects includes converting the target maturity data to temperature and depth data.

In another aspect combinable with any of the previous aspects, simulating the hydrogen generation includes applying a geological heating rate or thermal history to a basin model including the kinetic parameters to provide generation rate data, timing data, and yield data for oil, hydrocarbon gases, and hydrogen in the subsurface formation.

In another aspect combinable with any of the previous aspects, identifying hydrogen sweet spots includes identifying regions of the subsurface formation having a higher generation rate of hydrogen than generation rates of ethane and methane.

In another aspect combinable with any of the previous aspects, simulating hydrogen generation includes determining thermal maturity data for the subsurface formation, and the target maturity data includes vitrinite reflectance data for effective hydrogen generation, dominant hydrogen generation, and peak hydrogen generation.

Another aspect combinable with any of the previous aspects includes determining a hydrogen resource potential in the subsurface formation based on the simulated hydrogen generation, the total organic content, and a volumetric estimation of the identified hydrogen sweet spots in the subsurface formation.

In another example implementation, a system for identifying natural hydrogen sweet spots in a subsurface formation includes at least one processor; and a memory storing instructions that, when executed by the at least one processor, cause the at least one processor to perform operations including performing pyrolysis of the rock samples to determine an amount of hydrogen generated in the rock samples; determining kinetic parameters based on the performed pyrolysis and a thermal history of the subsurface formation; simulating hydrogen generation in the subsurface formation based on the determined kinetic parameters to predict target maturity data for hydrogen richness in the subsurface formation; measuring total organic content and rock sample maturity data for the rock samples; and identifying hydrogen sweet spots in the subsurface formation based on the target maturity data, the total organic content, and the measured rock sample maturity data.

In an aspect combinable with the example implementation, the operations include in response to identifying hydrogen sweet spots, drilling one or more wells in the subsurface formation to access the hydrogen sweet spots.

In another aspect combinable with any of the previous aspects, the operations include controlling production equipment to produce hydrogen from the one or more wells.

In another aspect combinable with any of the previous aspects, the operations include measuring thermal maturity of cuttings or core samples taken from the one or more wells to validate the identified hydrogen sweet spots.

In another aspect combinable with any of the previous aspects, the subsurface formation includes an organic rich shale formation or a coal formation.

In another aspect combinable with any of the previous aspects, the operations include converting the target maturity data to temperature and depth data.

In another aspect combinable with any of the previous aspects, simulating the hydrogen generation includes applying a geological heating rate or thermal history to a basin model including the kinetic parameters to provide generation rate data, timing data, and yield data for oil, hydrocarbon gases, and hydrogen in the subsurface formation.

In another aspect combinable with any of the previous aspects, identifying hydrogen sweet spots includes identifying regions of the subsurface formation having a higher generation rate of hydrogen than generation rates of ethane and methane.

In another aspect combinable with any of the previous aspects, simulating hydrogen generation includes determining thermal maturity data for the subsurface formation, and the target maturity data includes vitrinite reflectance data for effective hydrogen generation, dominant hydrogen generation, and peak hydrogen generation.

In another aspect combinable with any of the previous aspects, the operations include determining a hydrogen resource potential in the subsurface formation based on the simulated hydrogen generation, the total organic content, and a volumetric estimation of the identified hydrogen sweet spots in the subsurface formation.

What is claimed is:

1. A method for identifying natural hydrogen sweet spots in a subsurface formation, the method comprising:

obtaining rock samples from the subsurface formation;

performing pyrolysis of the rock samples to determine an amount of hydrogen generated in the rock samples;

determining kinetic parameters based on the performed pyrolysis and a thermal history of the subsurface formation;

simulating hydrogen generation in the subsurface formation based on the determined kinetic parameters and the thermal history to predict target maturity data for hydrogen richness in the subsurface formation;

measuring total organic content and rock sample maturity data for the rock samples; and identifying hydrogen sweet spots in the subsurface formation based on the target maturity data, the total organic content, and the measured rock sample maturity data.

2. The method of claim 1, further comprising in response to identifying hydrogen sweet spots, drilling one or more wells in the subsurface formation to access the hydrogen sweet spots.

3. The method of claim 2, further comprising controlling production equipment to produce hydrogen from the one or more wells.

4. The method of claim 2, further comprising measuring thermal maturity of cuttings or core samples taken from the one or more wells to validate the identified hydrogen sweet spots.

5. The method of claim 1, wherein the subsurface formation comprises an organic rich shale formation or a coal formation.

6. The method of claim 1, further comprising converting the target maturity data to temperature and depth data.

7. The method of claim 1, wherein simulating the hydrogen generation comprises applying a geological heating rate or thermal history to a basin model including the kinetic parameters to provide generation rate data, timing data, and yield data for oil, hydrocarbon gases, and hydrogen in the subsurface formation.

8. The method of claim 7, wherein identifying hydrogen sweet spots comprises identifying regions of the subsurface formation having a higher generation rate of hydrogen than generation rates of ethane and methane.

9. The method of claim 1, wherein simulating hydrogen generation comprises determining thermal maturity data for the subsurface formation, and wherein the target maturity data comprises vitrinite reflectance data for effective hydrogen generation, dominant hydrogen generation, and peak hydrogen generation.

10. The method of claim 1, further comprising determining a hydrogen resource potential in the subsurface formation based on the simulated hydrogen generation, the total organic content, and a volumetric estimation of the identified hydrogen sweet spots in the subsurface formation.

11. A system for identifying natural hydrogen sweet spots in a subsurface formation, the system comprising:

at least one processor; and a memory storing instructions that, when executed by the at least one processor, cause the at least one processor to perform operations comprising:

performing pyrolysis of rock samples to determine an amount of hydrogen generated in the rock samples;

determining kinetic parameters based on the performed pyrolysis and a thermal history of the subsurface formation;

simulating hydrogen generation in the subsurface formation based on the determined kinetic parameters to predict target maturity data for hydrogen richness in the subsurface formation;

measuring total organic content and rock sample maturity data for the rock samples; and identifying hydrogen sweet spots in the subsurface formation based on the target maturity data, the total organic content, and the measured rock sample maturity data.

12. The system of claim 11, wherein the operations further comprise in response to identifying hydrogen sweet spots, drilling one or more wells in the subsurface formation to access the hydrogen sweet spots.

13. The system of claim 12, wherein the operations further comprise controlling production equipment to produce hydrogen from the one or more wells.

14. The system of claim 12, wherein the operations further comprise measuring thermal maturity of cuttings or core samples taken from the one or more wells to validate the identified hydrogen sweet spots.

15. The system of claim 11, wherein the subsurface formation comprises an organic rich shale formation or a coal formation.

16. The system of claim 11, wherein the operations further comprise converting the target maturity data to temperature and depth data.

17. The system of claim 11, wherein simulating the hydrogen generation comprises applying a geological heating rate or thermal history to a basin model including the kinetic parameters to provide generation rate data, timing data, and yield data for oil, hydrocarbon gases, and hydrogen in the subsurface formation.

18. The system of claim 17, wherein identifying hydrogen sweet spots comprises identifying regions of the subsurface formation having a higher generation rate of hydrogen than generation rates of ethane and methane.

19. The system of claim 11, wherein simulating hydrogen generation comprises determining thermal maturity data for the subsurface formation, and wherein the target maturity data comprises vitrinite reflectance data for effective hydrogen generation, dominant hydrogen generation, and peak hydrogen generation.

20. The system of claim 11, wherein the operations further comprise determining a hydrogen resource potential in the subsurface formation based on the simulated hydrogen generation, the total organic content, and a volumetric estimation of the identified hydrogen sweet spots in the subsurface formation.

21. A method for identifying natural hydrogen sweet spots in a subsurface formation, the method comprising:

obtaining pyrolysis data from pyrolysis of rock samples performed to determine an amount of hydrogen generated in the rock samples;

determining kinetic parameters based on the pyrolysis data and a thermal history of the subsurface formation;

simulating hydrogen generation in the subsurface formation based on the determined kinetic parameters and the thermal history to predict target maturity data for hydrogen richness in the subsurface formation;

obtaining total organic content and rock sample maturity data for the rock samples; and identifying hydrogen sweet spots in the subsurface formation based on the target maturity data, the total organic content, and the rock sample maturity data.

* * * * *